US007846524B2

(12) United States Patent
Baglietto

(10) Patent No.: US 7,846,524 B2
(45) Date of Patent: Dec. 7, 2010

(54) MODULAR MAT

(76) Inventor: Julio Muro Baglietto, C/ Irunlarrea, 17 - 2° A, 31008 Pamplona (Navarra) (ES)

( * ) Notice: Subject to any disclaimer, the term of this patent is extended or adjusted under 35 U.S.C. 154(b) by 219 days.

(21) Appl. No.: 11/794,660

(22) PCT Filed: Jan. 11, 2006

(86) PCT No.: PCT/ES2006/000007

§ 371 (c)(1),
(2), (4) Date: Jul. 3, 2007

(87) PCT Pub. No.: WO2006/077272

PCT Pub. Date: Jul. 27, 2006

(65) Prior Publication Data

US 2009/0011167 A1 Jan. 8, 2009

(30) Foreign Application Priority Data

Jan. 18, 2005 (ES) ..... 200500083 U

(51) Int. Cl.
*B32B 3/06* (2006.01)
*A47L 23/24* (2006.01)

(52) U.S. Cl. ..... 428/54; 15/215

(58) Field of Classification Search ..... 428/54, 428/53, 52; 15/215; 52/177, 181
See application file for complete search history.

(56) References Cited

U.S. PATENT DOCUMENTS

| | | | | |
|---|---|---|---|---|
| 4,590,110 | A | 5/1986 | Arens | |
| 4,663,903 | A | 5/1987 | Ellingson, Jr. | |
| 4,804,570 | A * | 2/1989 | Bedics | 428/53 |
| 5,587,218 | A | 12/1996 | Betz | |
| 5,735,097 | A | 4/1998 | Cheyne | |
| 5,881,508 | A * | 3/1999 | Irvine et al. | 52/177 |
| 6,018,925 | A * | 2/2000 | Biro | 52/177 |
| 6,427,395 | B1 * | 8/2002 | Elsasser et al. | 52/181 |

FOREIGN PATENT DOCUMENTS

| | | |
|---|---|---|
| ES | 2 034 549 | 10/1989 |
| GB | 2 256 585 | 12/1992 |

* cited by examiner

*Primary Examiner*—Alexander Thomas
(74) *Attorney, Agent, or Firm*—Jerald L. Meyer; Jiaxiao Zhang; Sungyeop Chung

(57) ABSTRACT

The invention relates to a modular mat which is formed by base profiles (1) in the form of U-shaped grooves, with respect to 0which covering profiles determining the mat surface are incorporated by means of fitted coupling, the base profiles (1) being able to be joined by means of lateral engagement there between so as to form the desired mat extension.

4 Claims, 5 Drawing Sheets

MODULAR MAT

FIELD OF THE ART

The present invention relates to elements called mats which are placed on the floor for cleaning the soles of footwear, proposing a modular assembly embodiment which has very suitable features for the installation in places with heavy traffic.

STATE OF THE ART

In places for the entrance or passage from exterior spaces to interior enclosures, it is usual to place elements called mats for cleaning the sole of the footwear of the passersby, for the purpose of preventing the footwear from dirtying the interior floors.

To that end, the use of elements by way of floor mats which are arranged on the floor surface, which are practical in certain applications due to their cost-effectiveness and simplicity, as is the case of private housing and places with little traffic, is known, but this type of elements is not suitable in the case of large spaces and places with heavy traffic, because due to their nature they are not suitable for covering large surfaces efficiently and the use by multiple users further makes said mats move on the surface of the place on which they are located.

Fixing solutions have been developed to solve the problem of movement due to use, which leads to an increase in the cost and difficulty in the installation, in addition to the difficulty of removal for the cleaning, or the substitution if the deterioration so requires.

Modularity solutions and coupling assemblies have been developed to solve the extension problem, but the embodiments known in this sense are complex and expensive, the practical usefulness of their application being very limited.

OBJECT OF THE INVENTION

According to the invention, a modular assembly mat with embodiment features making it structurally and functionally advantageous is proposed.

This mat object of the invention essentially consists of base profiles in the form of a U-shaped groove, with respect to which an upper closing profile is incorporated by means of a fitted coupling, which closing profile is provided in its outer surface with a layer of elastic material, such as rubber or the like, defined with a rough configuration surface.

An assembly which is easy to install is thus obtained, as it only requires placing the base profile in the place of application, the closing profile being able to be incorporated by means of a simple fitting, which also allows removing said closing profile by a simple extraction for any necessary cleaning, maintenance or substation operation.

The assembly thus formed can have any desired length by cutting the component profiles with the corresponding measurement, while the base profile is provided with lateral engaging shapes allowing the successive collateral coupling of said profiles, a composition of any width thus being able to be formed, such that the formation dimensionality of the mat assembly is completely selective.

A sponge sheet is arranged under the base profiles, which sponge sheet determines a shock absorbance preventing the sonority of the mat and favoring the seating thereof in the installation, the composition of said sheet being provided with strips arranged in a transverse direction, a joining of the base profiles of the mat composition being established with said strips, whereby the assembly is reinforced providing consistency to the joining of the component profiles.

Due to the foregoing, said mat object of the invention has particular features providing it with its own identity and a preferred character with respect to the elements and assemblies known for the same application.

DETAILED DESCRIPTION OF THE INVENTION

The object of the invention relates to a modular formation mat, allowing a constructive embodiment with any measurement, both longitudinal and in width, with particular structure and assembly features.

Figure 1:
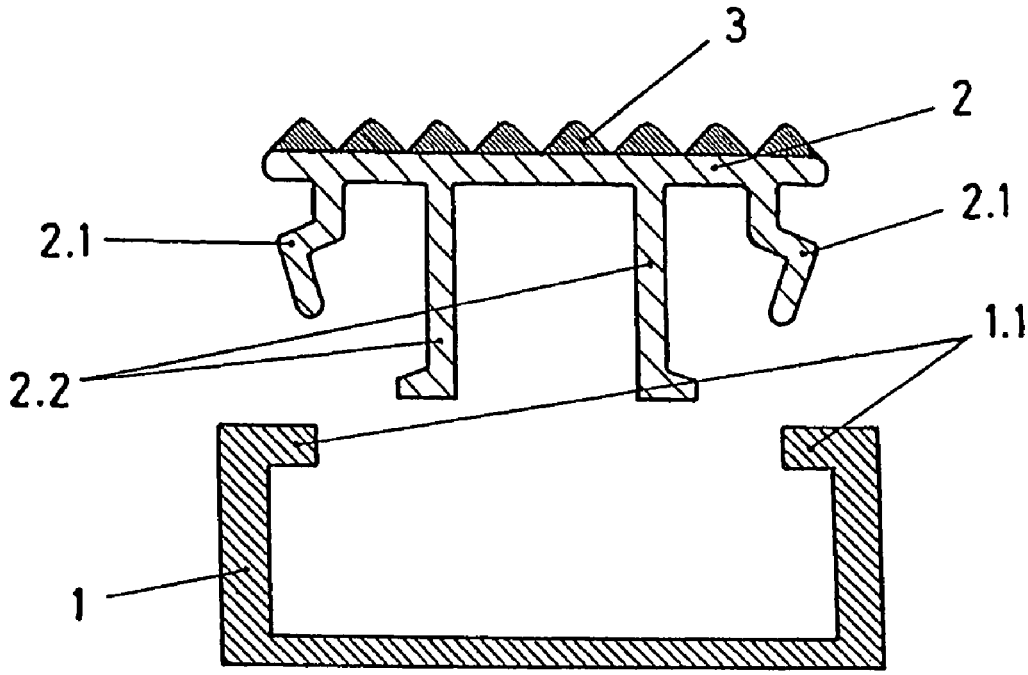
FIG. 1 shows a cross-sectional view of an assembly of elements of the mat of the invention with the corresponding elements separated in a correlative assembly position.
Figure 2:
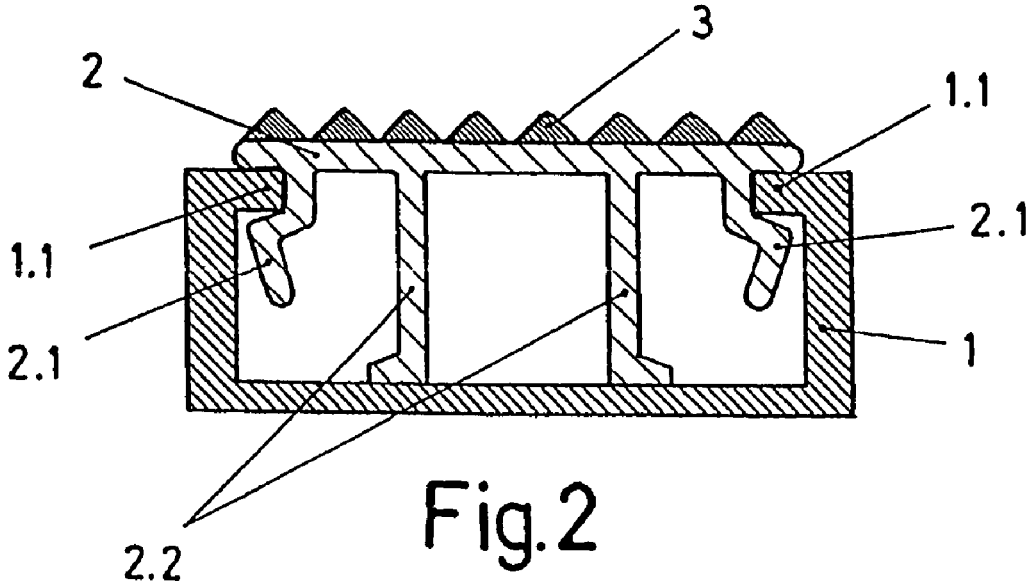
FIG. 2 shows a view of the previous assembly in an assembled manner.
Figure 3:
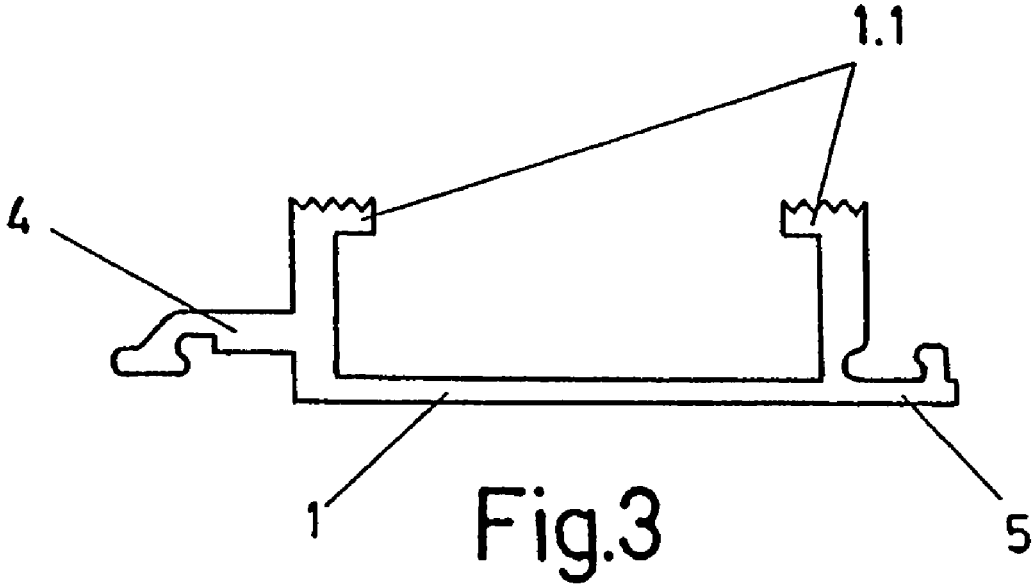
FIG. 3 shows a cross-sectional view of an example of a profile base with lateral engaging shapes.
Figure 4:
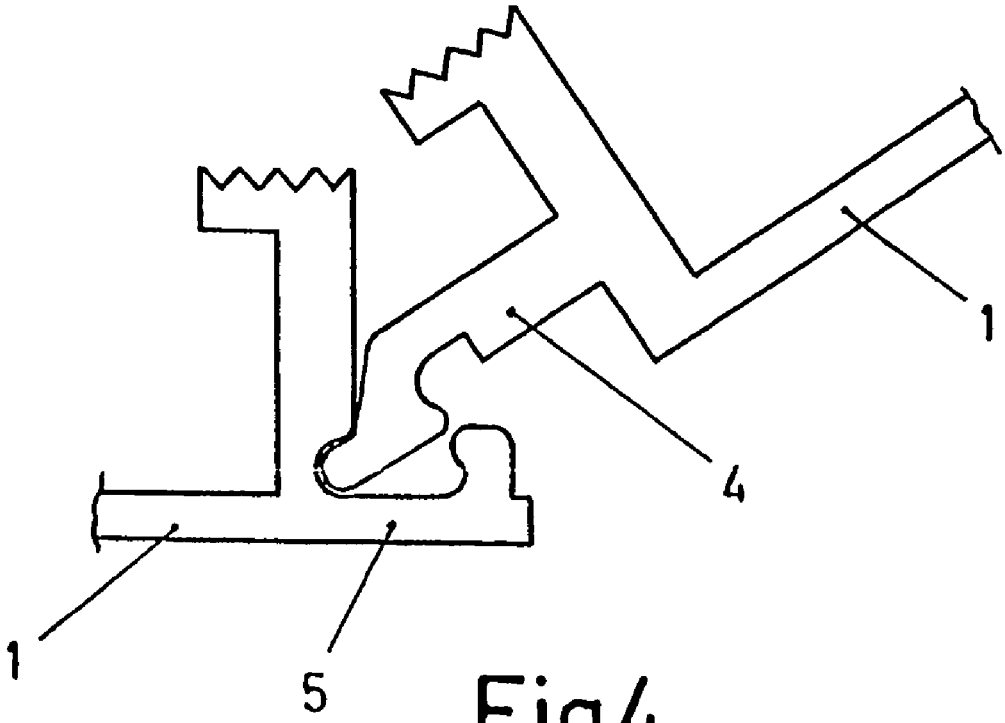
FIG. 4 shows a detailed view of the assembly insertion for the collateral engagement of two profiles such as that of the previous figure.
Figure 5:
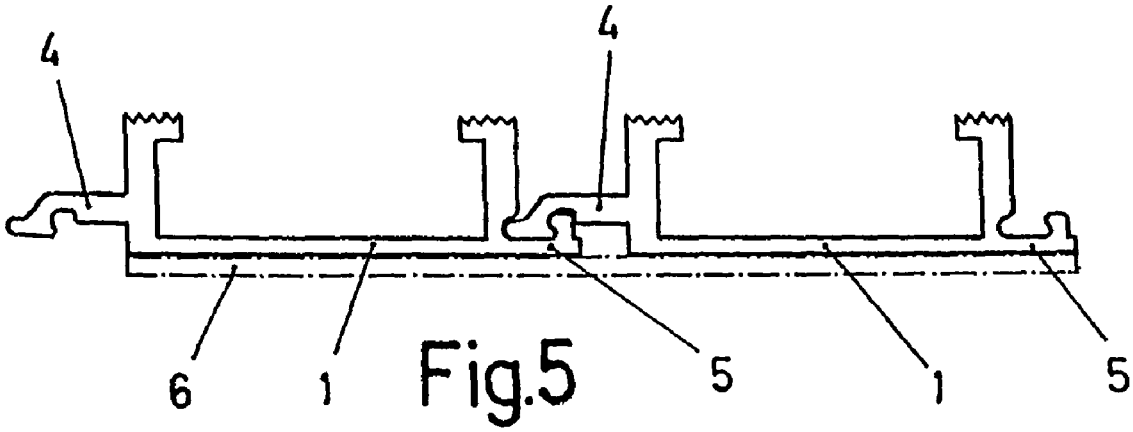
FIG. 5 shows a view of the two base profiles joined by means of the lateral engagement, with the lower sheet for the seating of the assembly represented by a dashed line.
Figure 6:
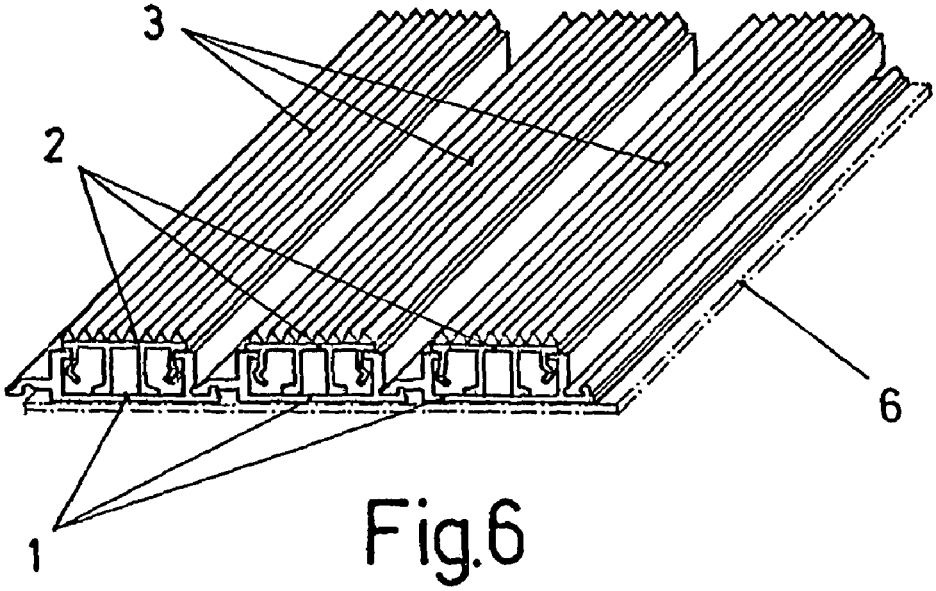
FIG. 6 shows a perspective view of three base profiles joined in the same manner as in the previous figure.

The proposed mat is essentially formed by a base profile (1) and a covering profile (2), which are coupled by means of fitting the covering profile (2) in the base profile (1), according to FIGS. 1 and 2.

To that end, the base profile (1) has a U-shaped grooved configuration, with upper edges (1.1) that are turned or thickened towards the inside, whereas the covering profile (2) has in its lower face zigzag pins or flanges (2.1) whereby a retaining seam is formed with respect to the edges (1.1) of the base profile (1) in the assembly coupling, said covering profile (2) further having pins or flanges (2.2) to abut against the bottom of the base profile (1).

The upper face of the covering profile (2) incorporates a layer (3) of synthetic material, such as rubber or the like, which layer is provided with a rough surface configuration, in the form of peaks or any type of projections, defining a face suitable to release the dirt in the sole of the footwear in the rubbing against it.

An assembly which is easy to install is thus obtained, as it only requires placing the base profile (1) in the place of application, to later incorporate the covering profile (2) by means of fitting; said assembly being able to be determined with the desired length by simply cutting the profiles (1 and 2) to the corresponding size.

The covering profile (2) can further be removed simply and quickly by means of a simple extraction, the maintenance and cleaning or substitution operations of said covering profile (2) being very easy to carry out when necessary.

In the practical embodiment, the base profile (1) is built with reciprocally corresponding lateral shapes (4 and 5) whereby the joining by engagement between successive profiles (1) is possible, so as to form a composition with the desired width, which allows forming mats of any size together with the cutting of the longitudinal measurement by means of successive identical base profiles (1) and respective covering profiles (2) incorporated thereon.

Figure 7:
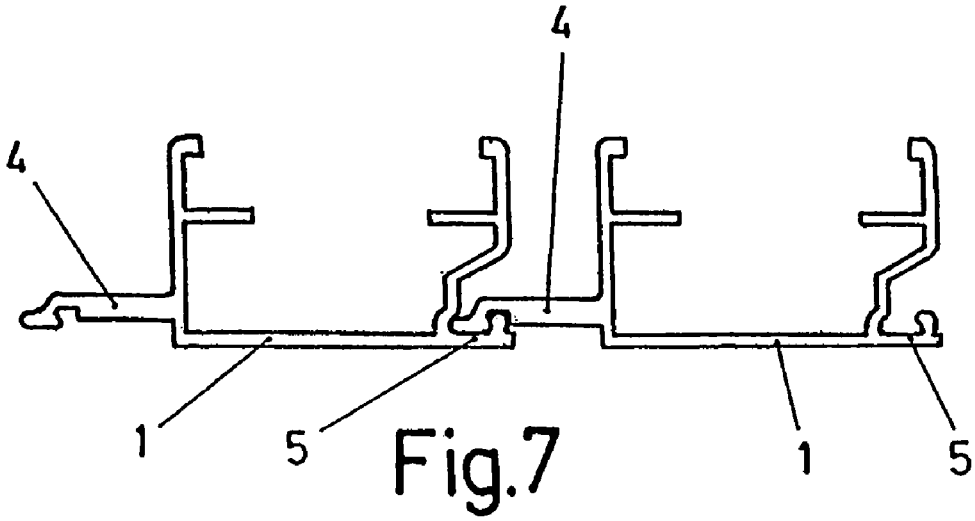
FIGS. 7 and 8 show respective views of respective base profiles joined by means of lateral engagement, according to other embodiments.
Figure 8:
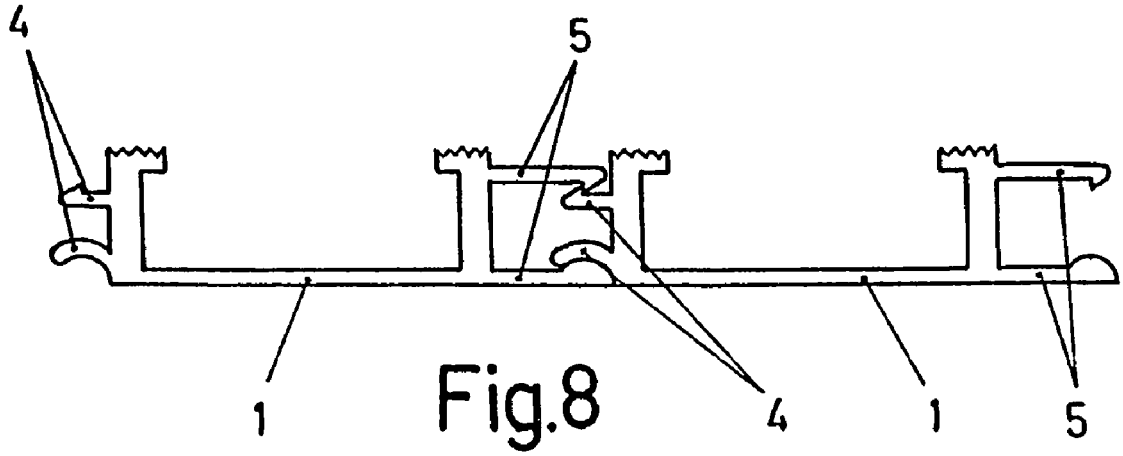

The reciprocal lateral shapes (4 and 5) of the base profiles (1) can have different shapes without this altering the concept of the invention, for example as in FIGS. 3 to 6, in which the shapes (4 and 5) determine a retaining engagement for the profiles (1), or as in FIG. 7, in which one of the shapes (5) is tucked in, such that the side part of the profiles (1) on this side has no projecting parts, being able to be placed against a vertical wall in the installation place, or as in FIG. 8, in which the shapes (4 and 5) determined a coupling for snap-fit fastening.

However, said embodiments are not limiting because, with the same concept of joining for fastening consecutive profiles (1) to one another, the shapes (4 and 5) can have different shapes.

A sponge sheet (6) or the like is arranged under the mat assembly, on which sponge sheet the base profiles (1) are supported, said sheet (6) thus forming a shock absorbance to prevent the sonority of the mat when it is stepped on.

According to a preferred embodiment, the sheet (6) is provided formed by strips which are arranged in a transverse direction of the mat composition, such that said sheet (6) further forms a means reinforcing the joining of the coupling between the profiles (1), making the assembly more compact.

Figure 9:
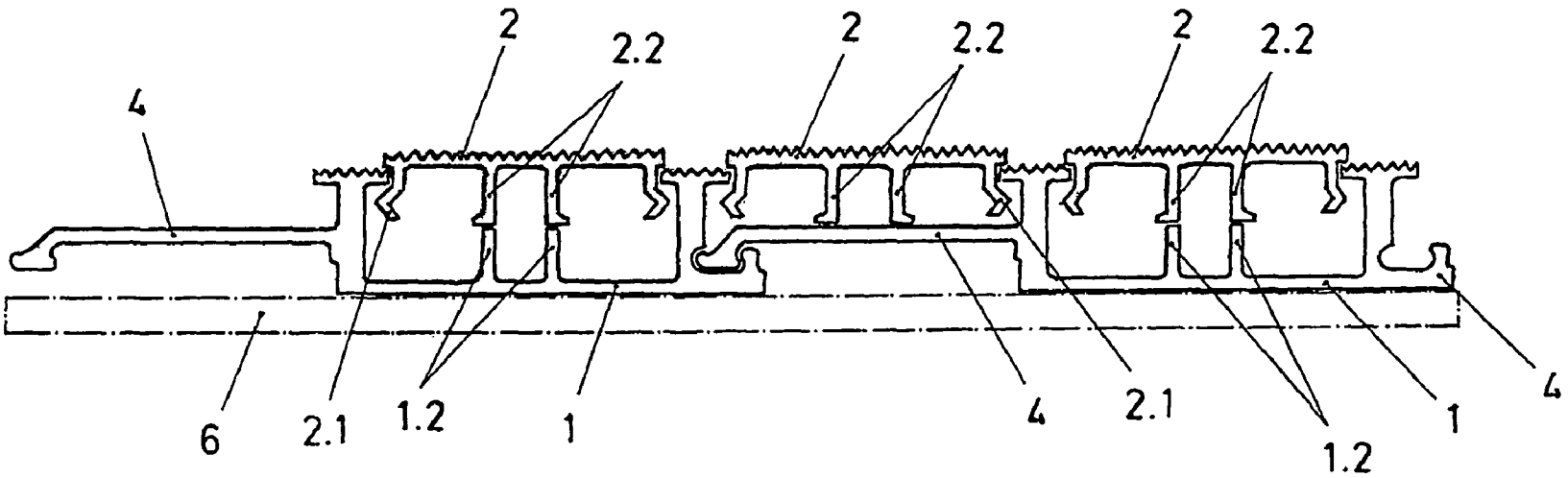
FIG. 9 shows a view of the formation of a mat with the base profiles joined by means of elongated lateral engaging shapes, incorporating respective identical covering profiles on each of the base profiles, as well as between them.

According to FIG. 9, in one embodiment it is provided that the lateral shapes (4 and 5) of the base profiles (1) are of a length such that in the coupling of the consecutive base profiles (1), the separation therebetween is equal to the width of the inner cavity of said base profiles (1), which allows placing respective identical covering profiles (2) both on each of the base profiles (1) and in the separation spaces therebetween, thus obtaining a continuous mat surface.

In this embodiment, the upper edges (1.1) of the base profiles (1) have a perpendicular extension or thickening towards both the inside and the outside to support the corresponding covering profiles (2), whereas ribs (1.2) rise from the bottom of the base profiles (1) to the height of the lateral engaging shapes (4 and 5), so that the support of the covering profiles (2) by means of the flanges (2.2) is carried out at the same height in all cases, such that all the covering profiles (2) can be identical.

The invention claimed is:

1. A modular mat, formed by assemblies of elements that are coupled to one another, wherein each assembly of elements comprises a base profile in the form of a U-shaped groove, and a covering profile that is incorporated into the base profile, the covering profile being provided with an elastic material surface defined as a rough surface or with any type of projections, the base profile having upper edges that are turned or thickened towards the inside, wherein the covering profile includes in its lower face zigzag pins or flanges whereby a snap-fit fastening is formed with respect to the edges in the assembly between the base and covering profiles, wherein the base profile defines at its sides shapes with a reciprocal configuration, whereby successive base profiles are collaterally joined to form a mat composition in width, the shapes being configured for an engagement joining.

2. The modular mat according to claim 1, wherein the base profiles incorporate at their sides engaging shapes with a length determining a separation between the base profiles, the shapes being joined to inner cavities of said base profiles, allowing the covering profiles to be present both on each of the base profiles and in the separation spaces between the base profiles, so as to determine a continuous mat surface.

3. The modular mat according to claim 1, wherein the base profiles incorporate at their sides engaging shapes with a length determining a separation between the base profiles, the shapes being joined to inner cavities of said base profiles, allowing the covering profiles to be present both on each of the base profiles and in the separation spaces there between, so as to determine a continuous mat surface.

4. A modular mat, formed by assemblies of elements that are coupled to one another, wherein each assembly of elements comprises a base profile in the form of a U-shaped groove, and a covering profile that is incorporated into the base profile, the covering profile being provided with an elastic material surface defined as a rough surface or with any type of projections;

wherein the base profile includes upper edges that are turned or thickened towards the inside, wherein the covering profile includes in its lower face zigzag pins or flanges whereby a snap-fit fastening is formed with respect to the edges in the assembly between the base and covering profiles;

wherein the base profile defines at its sides shapes with a reciprocal configuration, whereby successive base profiles are collaterally joined to form a mat composition in width;

wherein the shapes are configured for an engagement joining;

wherein a shock absorbing sheet is positioned under the mat; and wherein the base profiles incorporate at their sides engaging shapes with a length determining a separation between the base profiles, the shapes being joined to inner cavities of said base profiles, allowing the covering profiles to be present both on each of the base profiles and in the separation spaces between the base profiles, so as to determine a continuous mat surface.

* * * * *